US009121419B2

(12) United States Patent
Schaber

(10) Patent No.: US 9,121,419 B2
(45) Date of Patent: Sep. 1, 2015

(54) HYDRAULIC DRIVE DEVICE HAVING TWO PRESSURE CHAMBERS AND METHOD FOR OPERATING A HYDRAULIC DRIVE DEVICE HAVING TWO PRESSURE CHAMBERS

(75) Inventor: Hubert Schaber, Rutesheim (DE)

(73) Assignee: VOITH PATENT GMBH, Heidenheim (DE)

( * ) Notice: Subject to any disclaimer, the term of this patent is extended or adjusted under 35 U.S.C. 154(b) by 1053 days.

(21) Appl. No.: 13/145,930

(22) PCT Filed: Jan. 11, 2010

(86) PCT No.: PCT/EP2010/050199

§ 371 (c)(1),
(2), (4) Date: Jul. 22, 2011

(87) PCT Pub. No.: WO2010/084043

PCT Pub. Date: Jul. 29, 2010

(65) Prior Publication Data

US 2011/0271667 A1 Nov. 10, 2011

(30) Foreign Application Priority Data

Jan. 23, 2009 (DE) ..... 10 2009 005 998

(51) Int. Cl.
*F15B 9/09* (2006.01)
*F15B 15/20* (2006.01)
*F15B 13/04* (2006.01)

(52) U.S. Cl.
CPC ..... *F15B 15/204* (2013.01); *F15B 9/09* (2013.01); *F15B 13/0403* (2013.01)

(58) Field of Classification Search
CPC ..... F15B 9/09; F15B 9/10
USPC ..... 91/378, 165
See application file for complete search history.

(56) References Cited

U.S. PATENT DOCUMENTS 3,587,394 A * 6/1971 Hilbrands ..... 91/378
3,664,234 A * 5/1972 Simons et al. ..... 91/378

(Continued)

FOREIGN PATENT DOCUMENTS

| | | |
|---|---|---|
| DE | 19632368 | 2/1998 |
| EP | 0296104 | 12/1988 |
| EP | 1426622 | 6/2004 |

OTHER PUBLICATIONS

PCT/EP2010/050199 International Search Report dated Apr. 27, 2010.

(Continued)

*Primary Examiner* — F. Daniel Lopez
(74) *Attorney, Agent, or Firm* — Michael Best & Friedrich LLP

(57) ABSTRACT

The invention relates to a hydraulic drive device, comprising a piston which is guided displaceably in a cylinder chamber along a working axis and adjoins a working pressure chamber that can be pressurized by hydraulic fluid, and comprising a control means that is guided in the piston at least in some sections between different control states in order to control the flow of the hydraulic fluid from a high pressure supply into the working pressure chamber to move the piston in the working direction and from the working pressure chamber to a return flow chamber, wherein the region of the piston facing away from the working pressure chamber delimits a low pressure chamber that is pressurized by a low pressure supply for hydraulic fluid during the operation of the device such that the piston is moved back against the working direction when the control means connects the working pressure chamber to the return flow chamber. The invention furthermore relates to a method for operating a hydraulic drive device.

9 Claims, 4 Drawing Sheets

(56) References Cited

U.S. PATENT DOCUMENTS

| | | | | |
|---|---|---|---|---|
| 3,961,561 | A * | 6/1976 | Knutson | 91/378 |
| 4,673,162 | A | 6/1987 | Lachmann | |
| 4,825,745 | A | 5/1989 | Kuttruf | |
| 7,370,569 | B2 | 5/2008 | Schmidt et al. | |

OTHER PUBLICATIONS

PCT/EP2010/050199 Written Opinion.
DE 102009005998.9-14 Search Report dated Sep. 25, 2009.

* cited by examiner

HYDRAULIC DRIVE DEVICE HAVING TWO PRESSURE CHAMBERS AND METHOD FOR OPERATING A HYDRAULIC DRIVE DEVICE HAVING TWO PRESSURE CHAMBERS

CROSS-REFERENCE TO RELATED APPLICATIONS

This patent application is a national stage filing under 35 U.S.C. 371 of International Application No. PCT/EP2010/050199, filed 11 Jan. 2010, which claims foreign priority to German Patent Application No. 102009005998.9, filed 23 Jan. 2009, the disclosures of which are incorporated by reference herein in their entireties. Priority to each application is hereby claimed.

BACKGROUND OF THE INVENTION

The invention relates to a hydraulic drive device comprising a piston which is displaceably guided in a cylinder chamber along a working axis, and which defines a working pressure chamber which may be pressurized by hydraulic fluid, and comprising a control means guided in the piston at least partially between various control states, for controlling the throughflow of hydraulic fluid from a high pressure supply into the working pressure chamber to move the piston in the working direction, and from the working pressure chamber to a return flow chamber. The invention further relates to a method for operating a hydraulic drive device comprising a piston which is displaceably guided in a cylinder chamber and which defines a working pressure chamber, the working pressure chamber being pressurized by hydraulic fluid to move the piston in the working direction.

Hydraulic drive devices and methods of the aforementioned type are known in various embodiments. In this respect, reference is made to the prior art, for example, to EP 0 296 104 B1. A common feature in the prior art is that retraction and extension movements of the piston are effected by means of hydraulic fluid from a high pressure supply. Such devices are used, in particular, in stamping, punching, nibbling, bending or forming machines. In this typically highly dynamic operation, naturally the volumetric flow of hydraulic fluid from the high pressure supply is high, and sufficient energy has to be provided.

Further hydraulic drives have been disclosed in DE 37 20 266 C2 and EP 0 296 104 B1.

SUMMARY OF THE INVENTION

The object of the invention is to permit an energy-saving hydraulic operation, in particular for use in stamping, embossing, nibbling, bending or forming machines.

Accordingly, it is provided according to the invention that the region of the piston remote from the working pressure chamber defines a low pressure chamber which, during operation of the device, is pressurized from a low pressure supply for hydraulic fluid such that the piston is moved back counter to the working direction when the control means connects the working pressure chamber to the return flow chamber.

As the return movement of the piston is effected by hydraulic fluid from a low pressure supply, in a working cycle consisting of extending and retracting the piston, the energy requirement of the device is considerably reduced. In particular when used in stamping, punching, nibbling, bending or forming machines with a naturally high number of repetitive operating cycles, a considerable energy saving is achieved. In the hydraulic drive devices known hitherto from the prior art, however, the return movement of the piston is also associated with a volumetric flow of hydraulic fluid from a high pressure supply, which involves a considerable loss of energy.

The piston advantageously defines not only the working pressure chamber and the return flow chamber, but also a high pressure chamber and a low pressure chamber. Pressurizing the working pressure chamber with hydraulic fluid thus produces a force on the piston in the working direction, whilst pressurizing the low pressure chamber produces a force on the piston counter to the working direction. The return flow chamber is, in particular, connected to a tank via a tank connection, and serves to discharge hydraulic fluid from the working pressure chamber. The high pressure chamber is connected to the high pressure supply, in particular, via a high pressure connection and serves to supply the working pressure chamber with hydraulic fluid. Separately therefrom, the low pressure chamber is connected to the low pressure supply, in particular, via a low pressure connection. The high pressure chamber and the low pressure chamber are thus, in particular, configured so that, when pressurized, no forces act on the working piston in or counter to the working direction.

A development of the invention provides that the low pressure chamber is separated from the high pressure supply irrespective of the control state of the control means. Hydraulic fluid is thus only removed from the high pressure supply during the working step (i.e. during the forward movement), in which by filling the working pressure chamber with hydraulic fluid the piston is moved in the working direction. With the return movement of the piston, no hydraulic fluid flows from the high pressure supply.

As a preferred embodiment of the invention, adjustment means are provided, by means of which the pressure of the high pressure supply may be adjusted according to the displacement path of the piston and/or the working load of the piston. Thus a further energy saving is possible as the full effect of the force of the piston is often only required for a fraction of the total piston movement. As a result, not only is energy saved with the return of the piston, as disclosed above, but the energy requirement is also reduced during the forward movement of the piston.

Advantageously, the adjustment means are configured such that the pressure of the high pressure supply for moving the piston from its retracted end position in the working direction until, or just before, receiving a working load has a value p1 and subsequently, in particular when the working load is applied, has a value p2. Thus p1 is less than p2.

Moreover, the adjustment means are advantageously configured such that with a further movement of the piston in the working direction after overcoming the working load, the pressure of the high pressure supply has a value p3, p3 being less than p2 and/or p3 being the same as p1.

Thus it is achieved that an increased energy requirement of the high pressure source only occurs in the region of the working load, for example during the forming of a workpiece by the movement of the piston. Until the working load is applied, the piston is moved forward using reduced energy consumption.

As an advantageous development, a path measuring system is provided for determining the displacement path (i.e. the position) of the piston and/or a load measuring system for determining the working load of the piston. In cooperation with the adjustment means for the pressure of the high pressure supply, said measuring systems permit an optimized high pressure connection for further energy saving.

As a further embodiment of the invention it is provided that the control means, in the region in which it is guided in the piston, defines a pressure chamber in the working direction, said pressure chamber being connected in a pressurized manner to the low pressure chamber.

A preferred embodiment of the invention is produced by the control means being designed as a control slide valve which is guided along the working axis, and which is at least partially guided inside the piston, and which has control edges which are configured for cooperating with further control edges on the piston in order to control the throughflow of hydraulic fluid into or out of the working pressure chamber. If the control slide valve as described above, in the region in which it is guided in the piston, defines in the working direction a pressure chamber which is connected in a pressurized manner to the low pressure chamber, the control slide valve is continuously subjected to a force counter to the working direction. For actuation, the control slide valve, therefore, only has to be pushed in the working direction, not pulled in the opposite direction. Alternatively, it is also conceivable to use a control means which may be rotated about its longitudinal axis.

The control slide valve may thus be configured in one piece or in multiple parts, individual parts of the control slide valve being able to be connected together, in particular via joints. In particular, alignment errors may be compensated thereby.

The control slide valve may, on the one hand, also be guided in the region of the piston adjacent to the low pressure chamber in a cylindrical guide opening and, on the other hand, in the cylinder housing in a further cylindrical guide opening, the guide openings having the same diameter.

As a development of the invention, a coupling rod is provided for actuating the control slide valve, such that the control slide valve may be displaced by means of the coupling rod in the working direction of the piston. If the control slide valve as described above defines a pressure chamber in the piston, which is connected in a pressurized manner to the low pressure chamber, a force acts on the control slide valve continuously counter to the working direction. The coupling rod, therefore, for actuating the control slide valve only has to push said control slide valve in the working direction, but not pull the control slide valve. Thus it is not necessary for the control rod and control slide valve to be fixedly connected together. In particular, the coupling rod may simply loosely bear against the control slide valve.

Advantageously, the coupling rod is connected to an electromechanical transducer. In particular, it may be provided that the electromechanical transducer is designed as a linear direct motor, and the rotor thereof which is mobile along the working axis is fixedly connected to the coupling rod.

In a method for operating a hydraulic working device comprising a piston which is displaceably guided in a cylinder chamber, and which defines a working pressure chamber, the working pressure chamber is subjected to hydraulic fluid at a high pressure PH for moving the piston in the working direction. According to the invention, for returning the piston counter to the working direction a low pressure chamber which is defined by a region of the piston remote from the working pressure chamber, is subjected to a low pressure PN. Thus PN<=PH. For carrying out the method, in particular, a hydraulic working device according to the invention is used. Thus it is achieved that the return movement of the piston counter to the working direction is carried out in an energy-saving manner by hydraulic fluid at low pressure. Hydraulic fluid at high pressure is only required for moving the piston in the working direction.

The method may also be embodied such that the pressure of the hydraulic fluid pressurizing the working pressure chamber is adjusted according to the displacement path of the piston and/or the working load of the piston.

As a further embodiment, the low pressure chamber is subjected continuously to low pressure.

It is particularly preferred if the high pressure of the hydraulic fluid pressurizing the working pressure chamber, for moving the piston from its retracted end position in the working direction until, or just before, receiving a working load has a value p1 and subsequently, in particular when the working load is applied, has a value p2, p1 being less than p2. In the event that a further movement of the piston is provided in the working direction after overcoming the working load, the high pressure has a value p3, p3 being less than p2 and/or p3 being the same as p1.

BRIEF DESCRIPTION OF THE DRAWINGS

Further details and advantageous embodiments of the invention are to be derived from the following description, with reference to which the embodiment of the invention shown in the figures is described and explained in more detail.

In the drawings.

DETAILED DESCRIPTION

Figure 1:
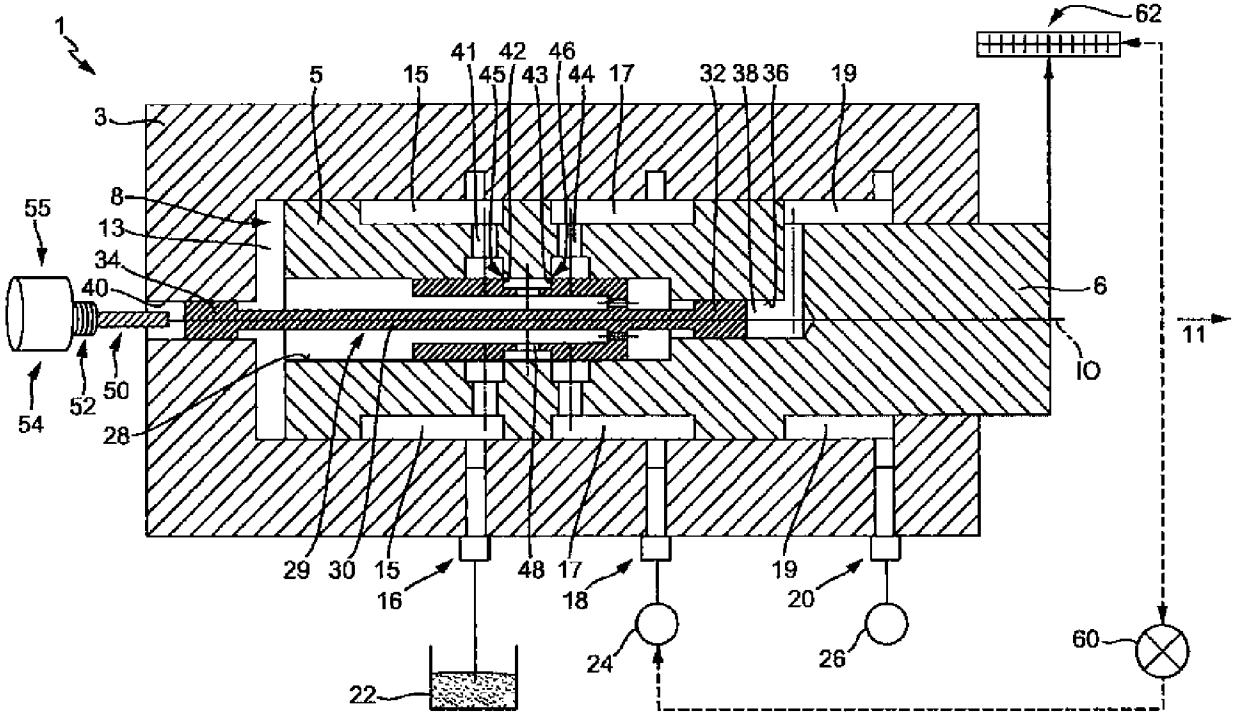
FIG. 1 shows a longitudinal section through a hydraulic drive device according to the invention in the resting position.
Figure 2:
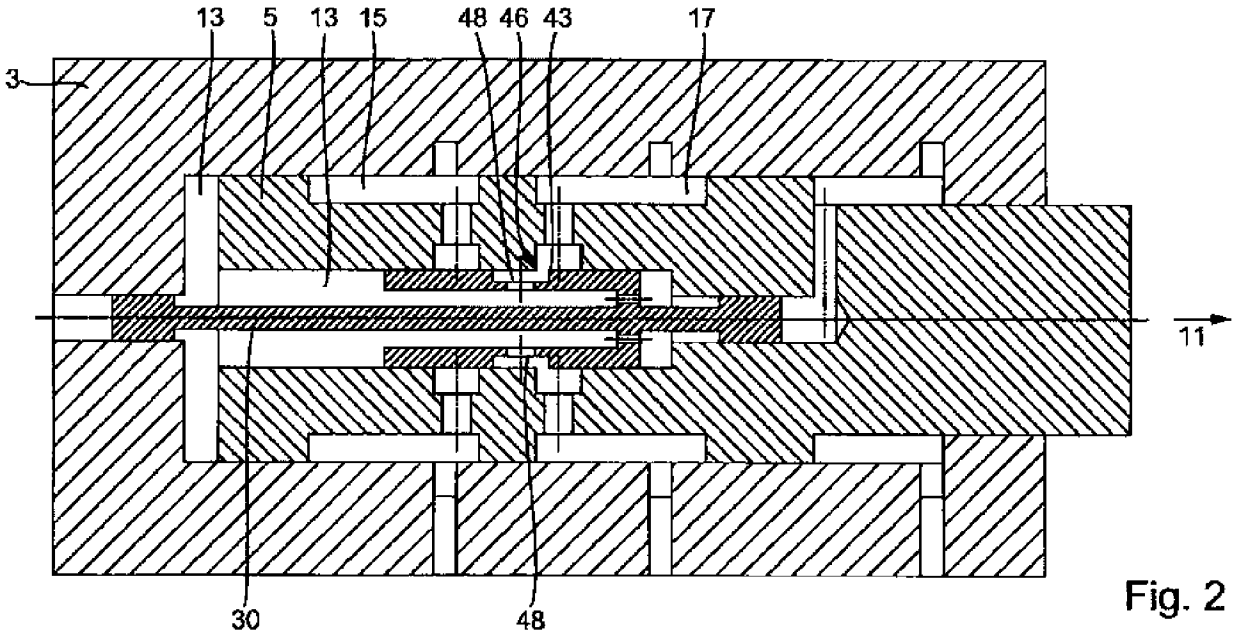
FIG. 2 shows a part of the drive device according to FIG. 1 as a longitudinal section, in the state for extending the piston.
Figure 3:
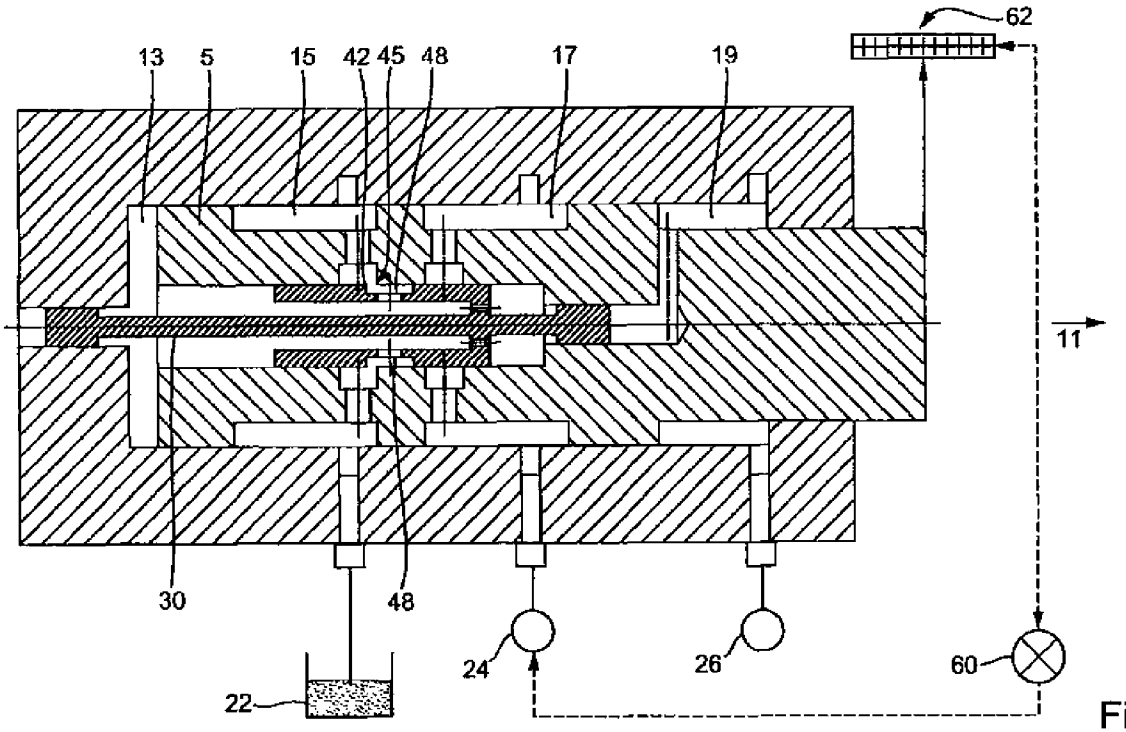
FIG. 3 shows a part of the drive device according to FIG. 1 as a longitudinal section, in the state for retracting the piston.

The hydraulic working device shown in FIGS. 1-3, has a cylinder 3 and a piston 5. The piston 5 is displaceably and sealingly guided in a cylinder chamber 8 along a working axis 10. The piston 5 is integrally connected to a piston rod 6, which protrudes beyond the cylinder 3 in a working direction 11. The piston rod 6 may be connected, for example, to a stamping tool (not shown) for forming a workpiece (not shown). The piston 5 defines a working pressure chamber 13, a return flow chamber 15, a high pressure chamber 17 and a low pressure chamber 19 which, for operating the device in the manner described further below, are filled with hydraulic fluid. A pressurization of the working pressure chamber 13 with hydraulic fluid thus produces a force on the piston 5 in the working direction 11, whilst a pressurization of the low pressure chamber 19 produces a force on the piston 5 counter to the working direction 11. The return flow chamber 15 is connected to a tank 22 via a tank connection 16, and serves for discharging the hydraulic fluid. The high pressure chamber 17 is connected via a high pressure connection 18 to a high pressure supply 24 for hydraulic fluid and serves for supplying the working pressure chamber 13 with hydraulic fluid. Separately therefrom, the low pressure chamber 19 is connected via a low pressure connection 20 to a low pressure supply 26 for hydraulic fluid.

The piston 5 has a coaxial cylindrical bore 28, in which a control means 29 in the form of a control slide valve 30 is guided longitudinally displaceably and sealingly along the working axis 10. The axial end regions 32 and 34 of the control slide valve 30 are formed in the manner of a piston. The end region 32 on the piston side is thus sealingly guided in a cylindrical guide bore 36 in the piston 5 and in the piston 5 defines a pressure chamber 38 which is connected in a pressurized manner to the low pressure chamber 19. The end region 34 of the control slide valve 30, remote from the piston 5, is sealingly guided in a cylindrical guide bore 40 in the cylinder 3. The diameter of the guide bores 36 and 40 are thus of the same size.

The control slide valve 30 has through-apertures 48 with control edges 42 and 43. Said control edges are configured for cooperation with control edges 45 and 46 on the piston, in order to provide a hydraulic follow-up adjustment for the piston 5 and control slide valve 30. The return flow chamber 15 and the high pressure chamber 17 have, to this end, throughflow openings 41 and 44 which connect the return flow chamber 15 and the high pressure chamber to the axial bore 28 for the control slide valve 30. The control edges 45 on the piston side are thus connected to the throughflow opening 41 and thus to the return flow chamber 15, and the control edges 46 on the piston side are connected to the throughflow opening 44 and thus to the high pressure chamber 17. The control edges 42 and 43 on the control slide valve 30 are at the same, or a slightly shorter, distance from one another than the associated control edges 45 and 46. By displacing the control slide valve 30 along the working axis 10, as a result, the working pressure chamber 13 may either be connected in a pressurized manner to the return flow chamber 15 or to the high pressure chamber 17. The low pressure chamber 19, irrespective of the position of the control slide valve 30, is not connected in a pressurized manner to the high pressure chamber 17 or to the return flow chamber 15.

For actuating the control slide valve 30 a coupling rod 50 is provided, by means of which the control slide valve 30 may be displaced in the working direction 11. The coupling rod 50 thus bears only loosely against the piston-like end region 34 of the control slide valve 30. The coupling rod 50 is, on the other hand, fixedly connected to the rotor 52 of an electromagnetic transducer 54 which is designed, in particular, as a linear direct motor.

For adjusting the pressure of the high pressure supply 24, adjustment means 60 are provided. Said adjustment means adjust the pressure of the high pressure supply 24 depending on the displacement path, i.e. the position of the piston 5 in the working direction 11. The position of the piston 5 along the working axis 10 is determined via a path measuring system 62. It may further be provided that the adjustment means 60 adjust the pressure of the high pressure supply 24 depending on the working load of the piston 5, which is determined by means of a load measuring system (not shown).

During operation, the hydraulic drive device 1 operates in the manner described below. In the resting position shown in FIG. 1, the control slide valve 30 is held by the coupling rod 50 in the resting position. Thus the force acting by the low pressure in the pressure chamber 38 on the control slide valve 30, counter to the working direction 11, is compensated by the control rod 50. Moreover, a force equilibrium prevails between the force acting in the working direction 11 on the piston 5 by the hydraulic fluid located in the working pressure chamber 13 and the force acting counter to the working direction 11 on the piston 5 by the hydraulic fluid located in the low pressure chamber 19. A throughflow of hydraulic fluid from the high pressure chamber 17 into the working pressure chamber 13 or from the working pressure chamber 13 into the return flow chamber 15 is prevented, as the throughflow openings 41 and 44 are sealingly covered by the control slide valve 30.

If the coupling rod 50 is moved by the linear direct motor 54 in the working direction, the coupling rod 50 also pushes the control slide valve 30 in the working direction. As shown in FIG. 2, as a result a gap opens up between the control edges 43 on the control slide valve 30 and the control edges 46 on the piston 5. As a result, the high pressure chamber 17 is connected in a pressurized manner to the working pressure chamber 13, and hydraulic fluid flows from the high pressure supply 24 via the high pressure chamber 17 through the through-aperture 48 into the working pressure chamber 13. Consequently, a force acts in the working direction 11 on the piston 5 and the piston 5 is moved in the working direction 11. The piston 5 thus follows the movement of the control slide valve 30 until the control edges 43 and 46 again close as shown in FIG. 1, so that a throughflow of hydraulic fluid is prevented from the high pressure chamber 17 into the working pressure chamber 13 or from the working pressure chamber 13 into the return flow chamber 15. As a result, a resting position is present similar to the situation shown in FIG. 1.

The high pressure chamber 17 configured substantially as an annular space, extends in the axial direction to such an extent that the high pressure connection 18 is connected to the throughflow opening 44 over the entire stroke. During operation, namely when the throughflow opening 44 is closed by the control slide valve 30, the high pressure chamber 17 is subjected to high pressure; a force which has been produced to move the piston 5 in one direction, however, does not emerge from said high pressure chamber. Instead of the high pressure chamber 17, a hose connection could also be provided between the high pressure connection 18 and the throughflow opening 44.

The same applies to the return flow chamber 15 also configured as an annular chamber; it connects the throughflow opening 41 to the tank connection 16, without a resulting force acting on the piston 5. Also in this case, a hose connection could be provided between the tank connection 16 and the throughflow opening 41.

For returning the piston counter to the working direction 11, the coupling rod 50 is moved by the linear direct motor 54 counter to the working direction away from the region 34 of the control slide valve 30. By the low pressure prevailing in the pressure chamber 38, the control slide valve 30 is moved counter to the working direction 11. As shown in FIG. 3, as a result a gap opens up between the control edges 42 on the control slide valve 30 and the control edges 45 on the piston 5, so that the working pressure chamber 13 is connected in a pressurized manner to the return flow chamber 15. By the low pressure prevailing in the low pressure chamber 19, a force acts counter to the working direction 11 on the piston 5. The piston 5 may now move counter to the working direction 11, the hydraulic fluid located in the working pressure chamber 13 being displaced through the through-aperture 48 into the return flow chamber 15 and from there into the tank 22. The piston 5 and the control slide valve 30 move counter to the working direction 11, until a further movement of the control slide valve 30 is prevented by the end region 34 of the control slide valve 30 striking against the coupling rod 50. Then the control slide valve is again moved into a position in which the gap between the control edges 42 and 45 is closed. A resting position similar to the resting position shown in FIG. 1 is then present.

During typical use of the described hydraulic drive device, in a stamping machine for metal workpieces, the full working force of the piston 5 in the working direction 11 is not required during the entire working cycle, which consists of extending and retracting the piston 5. Instead, the full working force is only required when a stamping tool (not shown) connected to the piston rod 6 strikes a workpiece (not shown) and when penetrating the workpiece. In the exemplary embodiment described it is, therefore, provided that the adjustment means 60 adjust the pressure of the high pressure supply 24 depending on the displacement path, i.e. on the position of the piston 5.

Figure 4:
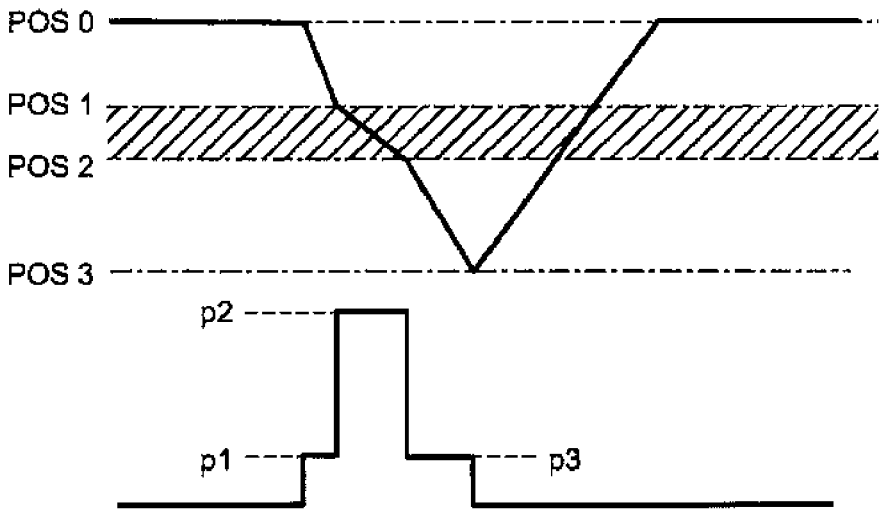
FIG. 4 shows the time characteristic of the displacement path of the piston and the adjusted pressure of the high pressure supply.

The time characteristic of the position of the piston 5 together with the time characteristic of the pressure of the high pressure supply 24 adjusted by the adjustment means 60 is shown in FIG. 4. Proceeding from the retracted end position POS0 of the piston 5, the piston 5 is moved in the working direction 11 as far as the position POS1 in which the stamping tool connected to the piston rod strikes the workpiece to be shaped. For this displacement path, the pressure of the high pressure supply 24 is adjusted to a low value p1 which, in particular, may be selected to be the same as the low pressure supply 26. The displacement path is at the same time detected by the path measuring system 62, and compared with a preset value which, for example, corresponds to the distance of the stamping tool in the retracted end position of the piston 5 from the workpiece. If the piston has been moved over the aforementioned distance, the stamping tool strikes the workpiece to be shaped. This occurs in the position of the piston denoted in FIG. 4 by POS1. Then the adjustment means 60 increase the pressure of the high pressure supply 24 to a value p2 which is markedly higher than p1 and typically corresponds to the maximum pressure of the high pressure supply 24. This high pressure is maintained for the further movement of the piston 5 in the working direction 11 for a sufficiently long time until the stamping tool attached to the piston rod 6 has penetrated the workpiece (position POS2 of the piston 5 in FIG. 4). Thus the working load on the piston 5 is reduced. If a further movement of the piston 5 in the working direction 11 is provided as far as the position POS3, the adjustment means 60 reduce the pressure of the high pressure supply 24 to a value p3, which is less than the pressure p2 and, in particular, is the same as the pressure of the low pressure supply 26.

During the return movement of the piston 5, counter to the working direction 11, the control slide valve 30 blocks a further throughflow of hydraulic fluid from the high pressure supply 24 into the working pressure chamber 13. A volumetric flow of hydraulic fluid from the high pressure supply 24, consuming a high level of energy, is thus prevented. The return movement is only effected by a volumetric flow of hydraulic fluid from the low pressure supply 26.

The disclosed exemplary embodiment of the invention considerably reduces the energy requirement in typical use, with repeated extending and retracting of the piston 5. This firstly occurs as the return movement of the piston 5 counter to the working direction 11, in principle, is effected by hydraulic fluid from an energy-saving low pressure supply 26. Secondly, the energy requirement is further reduced by the disclosed high pressure connection of the high pressure supply 24 which is dependent on the displacement path and/or the working load of the piston 5.

The invention claimed is:

1. A hydraulic drive device comprising:

a piston displaceably guided in a cylinder chamber along a working axis and defining a working pressure chamber which may be pressurized by a hydraulic fluid;

a control means guided in the piston at least partially between various control states, and configured to control the throughflow of the hydraulic fluid from a high pressure supply into the working pressure chamber to move the piston in a working direction, and from the working pressure chamber to a return flow chamber, wherein the control means, in the region in which it is guided in the piston, defines a pressure chamber in the working direction, said pressure chamber being connected in a pressurized manner to a low pressure chamber, wherein a region of the piston remote from the working pressure chamber defines the low pressure chamber which, during operation of the device, is pressurized by a low pressure supply of hydraulic fluid, such that the piston is moved back counter to the working direction when the control means connects the working pressure chamber to the return flow chamber, and adjustment means for adjusting a pressure of the high pressure supply according to a travelling distance in the working direction of the piston and/or a working load of the piston.

2. The drive device as claimed in claim 1, wherein the low pressure chamber is separated from the high pressure supply irrespective of the control state of the control means.

3. The drive device as claimed in claim 1, wherein the adjustment means is configured such that with a further movement of the piston in the working direction after overcoming the working load, the pressure of the high pressure supply has a value p3, p3<p2 and/or p3=p1.

4. The drive device as claimed in claim 1, wherein a path measuring system is provided for determining the travelling distance of the piston.

5. The drive device as claimed in claim 1, wherein the control means is designed as a control slide valve which is at least partially guided inside the piston along the working axis, and which has control edges which are configured for cooperating with further control edges on the piston, in order to control the throughflow of hydraulic fluid into or out of the working pressure chamber.

6. The drive device as claimed in claim 5, wherein the control slide valve, on a first end, is guided in the region of the piston adjacent to the low pressure chamber in a cylindrical guide opening and, on a second end, in the cylinder housing in a further cylindrical guide opening, the guide openings having the same diameter.

7. The drive device as claimed in claim 5, wherein a coupling rod is provided for actuating the control slide valve, such that the control slide valve may be displaced by the coupling rod in the working direction of the piston.

8. The hydraulic drive device as claimed in claim 7, wherein the coupling rod is connected to an electromechanical actuator.

9. A hydraulic drive device comprising:

a piston displaceably guided in a cylinder chamber along a working axis and defining a working pressure chamber which may be pressurized by a hydraulic fluid;

a control means guided in the piston at least partially between various control states, and configured to control the throughflow of the hydraulic fluid from a high pressure supply into the working pressure chamber to move the piston in a working direction, and from the working pressure chamber to a return flow chamber, wherein a region of the piston remote from the working pressure chamber defines a low pressure chamber which, during operation of the device, is pressurized by a low pressure supply for hydraulic fluid, such that the piston is moved back counter to the working direction when the control means connects the working pressure chamber to the return flow chamber; and wherein the control means, in the region in which it is guided in the piston, defines a pressure chamber in the working direction, said pressure chamber being connected in a pressurized manner to the low pressure chamber.

* * * * *